United States Patent [19]

Dean

[11] 3,992,791

[45] Nov. 23, 1976

[54] SLOPE GRADER WITH LONGITUDINALLY MOVABLE GUIDE FRAME

[76] Inventor: Americo Dean, R.R. No. 1 Belle River, Ontario, Canada

[22] Filed: Oct. 8, 1975

[21] Appl. No.: 620,556

[52] U.S. Cl. ..... 37/116; 212/144; 214/141; 172/26.5; 37/103

[51] Int. Cl.[2] ..... E02F 3/46

[58] Field of Search ..... 37/115, 116, 117, 117.5, 37/103, 71, 72, 80 R, 125; 172/26.5, 26.6; 212/54–57, 73, 144, 145; 214/131 R, 133, 135, 138, 140 R, 141, 15 C

[56] References Cited

UNITED STATES PATENTS

| | | | |
|---|---|---|---|
| 341,539 | 5/1886 | Angell | 37/72 |
| 677,522 | 7/1901 | Libbe | 37/103 |
| 1,137,171 | 4/1915 | Stansell | 37/117 |
| 1,640,565 | 8/1927 | Dennis | 37/71 X |
| 2,334,323 | 11/1943 | Gilbert | 212/55 X |
| 2,348,796 | 5/1944 | Ferwerda et al. | 37/80 R |
| 2,501,533 | 3/1950 | Miyagi | 37/125 |
| 2,640,286 | 6/1953 | Briscoe | 37/108 R X |
| 2,755,573 | 7/1956 | Bannister | 37/116 |
| 2,833,422 | 5/1958 | Ferwerda et al. | 212/55 |
| 3,008,251 | 11/1961 | Cline et al. | 214/131 X |
| 3,044,196 | 7/1962 | Kinney | 212/55 X |
| 3,809,250 | 5/1974 | Pilch | 212/55 |

FOREIGN PATENTS OR APPLICATIONS

| | | | |
|---|---|---|---|
| 630,381 | 5/1936 | Germany | 37/71 |
| 2,133,365 | 1/1973 | Germany | 37/71 |
| 102,041 | 5/1964 | Norway | 212/57 |
| 249,300 | 7/1969 | U.S.S.R. | 37/116 |

*Primary Examiner*—E. H. Eickholt

[57] ABSTRACT

An attachment for a jib crane to enable it to be used for grading and carrying out other work on sloping banks has a more or less horizontal auxiliary jib mounted beneath the main jib of the crane, a carriage movable fore and aft along the auxiliary jib, a guide frame extending forwardly from the carriage, a tool carrier movable in either direction along the length of the guide frame, and a suspension tie connecting the guide frame to the jib of the crane. The tool carriage is provided with a scraper blade or other tool appropriate to an operation to be carried out, and is hauled, usually upwardly, along the guide frame by a cable operated by the winding gear of the crane.

11 Claims, 4 Drawing Figures

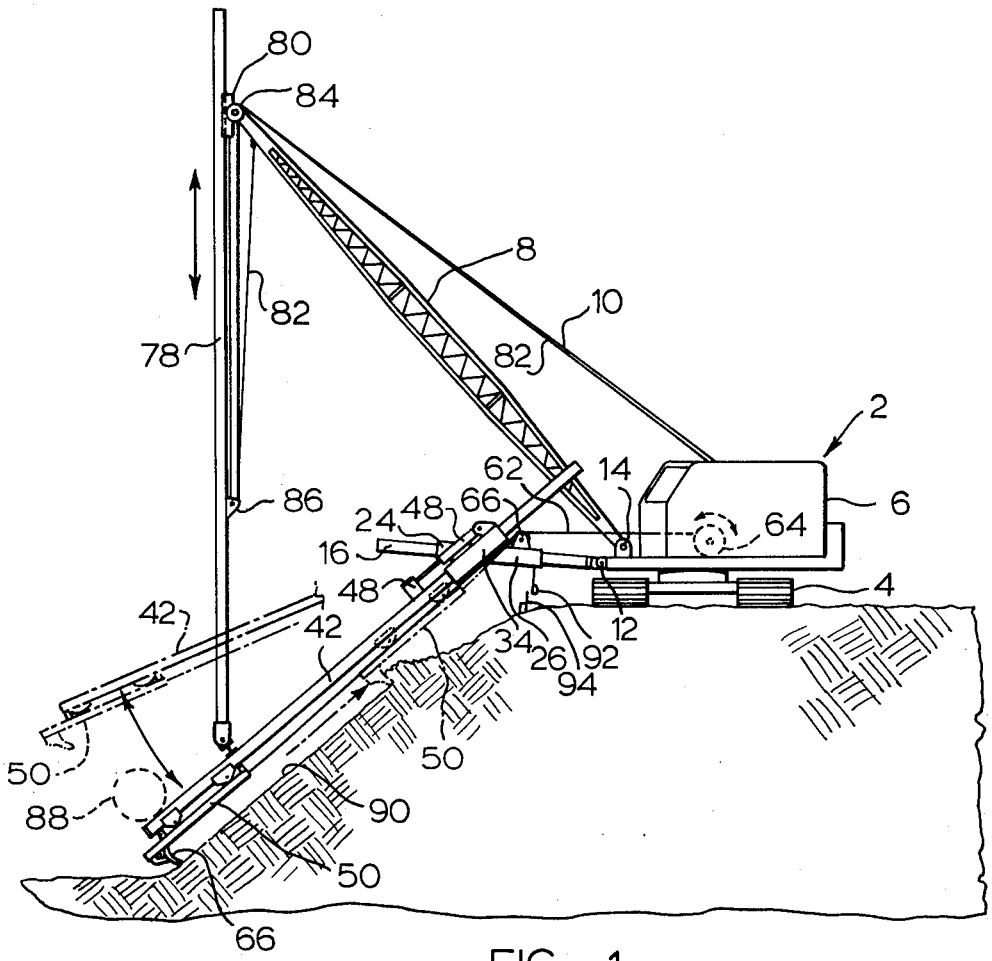
FIG. 1
FIG. 3
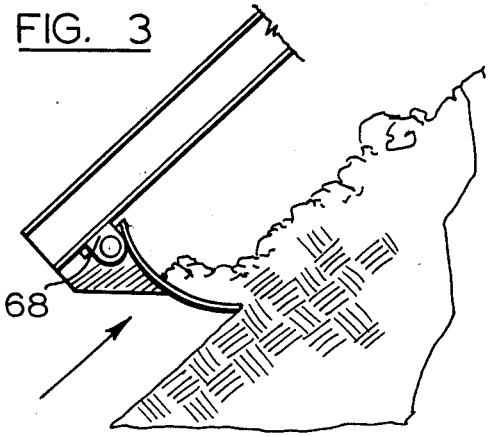
FIG. 4
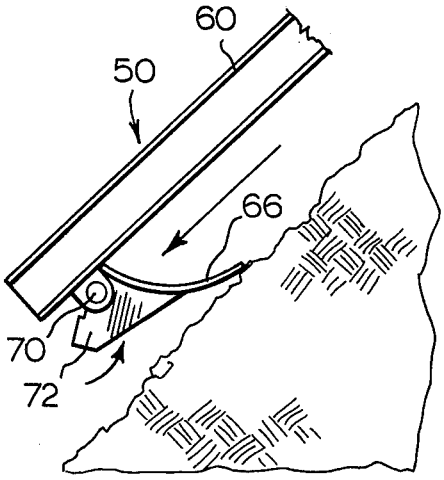

SLOPE GRADER WITH LONGITUDINALLY MOVABLE GUIDE FRAME

FIELD OF THE INVENTION

This invention relates to apparatus for grading or otherwise operating on slopes, for example the banks of rivers or the sides of cuts or fills in the building of roads or waterways, whilst operating from positions at the top or bottom of such slopes.

REVIEW OF THE PRIOR ART

Machines capable of grading and otherwise operating on slopes are known, but commercially available machines have a somewhat limited reach which, whilst adequate for such purposes as grading the banks of ditches, and the sides of cuts and fills of limited depth or height, have inadequate reach for certain applications, notably lengthy slopes where access for the apparatus is only available from the top of the bank. Such conditions can arise with deep cuts or fills, and in particular with the banks of large rivers where the slope to be graded may extend well below the water level.

Whilst it would no doubt be possible to develop machines of existing types to improve their reach, such machines would be of a specialized nature and very expensive.

One known means of obtaining a greater reach is provided by the dragline excavator in its various forms, but such excavators are not generally capable of grading or otherwise working a slope to a precise profile, due to inadequate control of the ground working tool.

SUMMARY OF THE INVENTION

The present invention provides economical means for the grading of lengthy slopes in the form of an attachment used in conjunction with a conventional jib crane.

Essentially, the device comprises a more or less horizontal auxiliary jib mounted beneath the main jib of the crane, a carriage movable fore and aft along the auxiliary jib, a guide frame extending forwardly from the carriage, a tool carrier movable in either direction along the length of the guide frame, and a suspension tie connecting the guide frame to the jib of the crane. The tool carriage is provided with a scraper blade or other tool appropriate to an operation to be carried out, and is hauled usually upwardly, along the guide frame by a cable operated by the winding gear of the crane. This enables a required grading action to be achieved, and in order to facilitate movement of the tool carrier in the downward or reverse direction, the blade or other tool may be hinged to the carrier.

The elevation of the scraper carriage relative to a surface being graded may be adjusted by moving the carriage fore or aft on the auxiliary jib, and in order to enable differing slopes to be graded, the inclination of the guide frame relative to the carriage may be made adjustable. The suspension tie will in most cases be rigid, so that the weight of the strut and the crane jib will resist unwanted upward displacement of the guide frame. Where the slope being graded is largely under water, the load on the crane may be reduced by providing buoyancy tanks at the forward end of the guide frame. The apparatus may be utilized in conjunction with known forms of string line control.

BRIEF DESCRIPTION OF THE DRAWINGS

The invention is described further with reference to the accompanying drawings, in which:

FIG. 1 is an elevation, showing apparatus according to the invention being utilized on a river bank (the latter being shown in section), FIGS. 3 and 4 are details illustrating one aspect of the operation of the device.

DESCRIPTION OF THE PREFERRED EMBODIMENT

Figure 2:
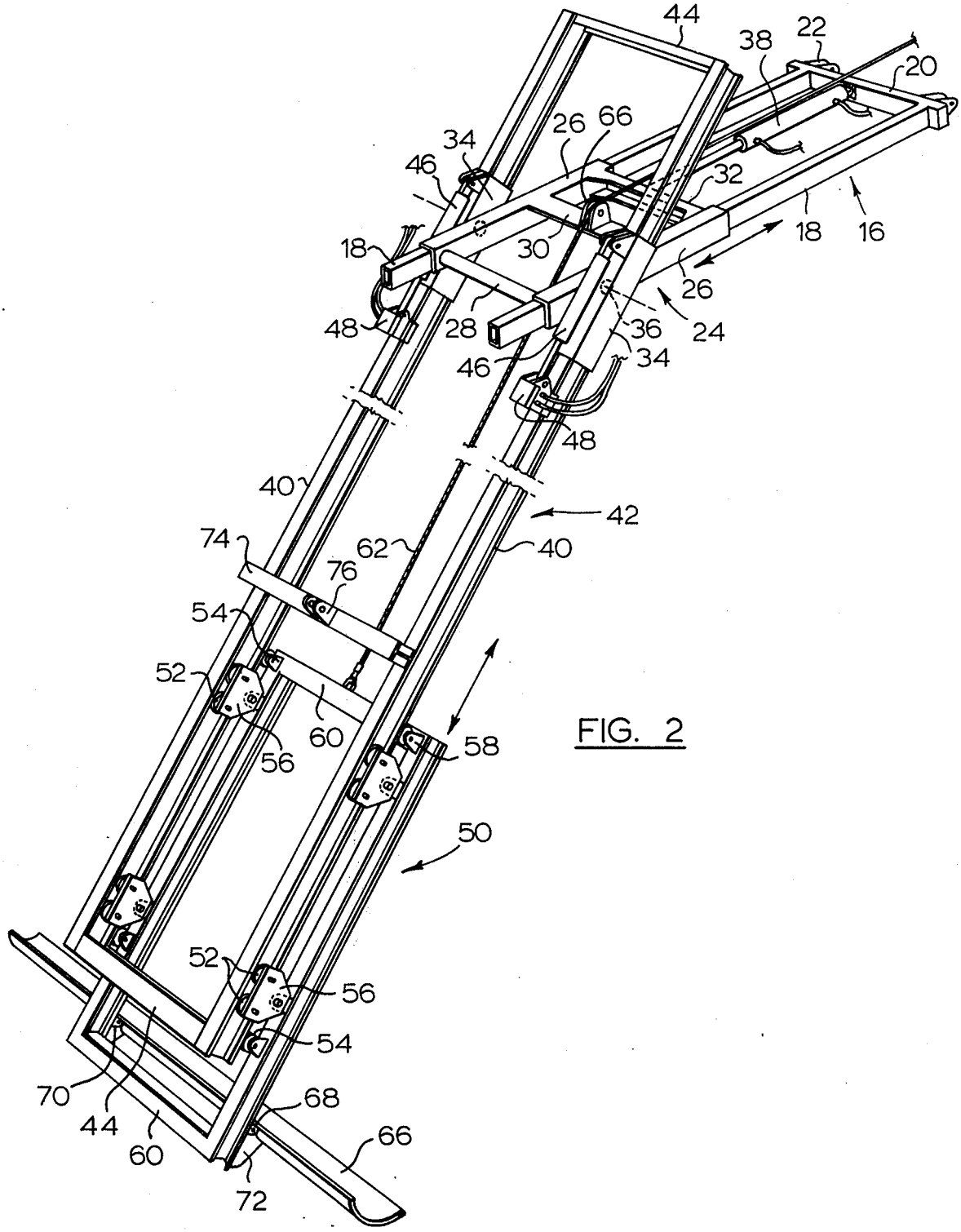
FIG. 2 is a detail on an enlarged scale showing in perspective major portions of a device in accordance with the invention.

FIG. 1 shows the device of the invention fitted to a conventional jib crane 2, comprising a track laying undercarriage 4, a rotatable superstructure 6 housing winding gear, and controls, and a jib 8, the elevation of which is controlled by a stay 10. The construction of the crane forms no part of the invention, and is only described insofar as is required for understanding the present invention. The capacity of the crane should of course be sufficient to sustain the loadings applied by the apparatus of the invention under the most unfavourable conditions of use.

Pivoted to the rotating superstructure 6 of the crane, by a pivot pin 12 adjacent the pivot pin 14 securing the jib 8 is an auxiliary jib 16, comprising, as best seen in FIG. 2, two box section rails 18 linked at their rear ends adjacent the pivots 12 by a cross member 20 carrying clevises apertured to receive the pivot pins 12.

A carriage 24 is mounted on the auxiliary jib 16 for fore and aft movement by means of sleeves 26 joined by cross members 28, 30 and 32. The carriage also carries guide sleeves 34 which extend at an angle to the sleeves 26, and are secured to the sleeves 26, either fixedly, or preferably in such a manner that the angles between the two sets of sleeves may be adjusted about a pivotal axis 36. The carriage 24 may be moved fore and aft on the auxiliary jib 16 by means of a hydraulic actuator 38 connected to a hydraulic system on the crane. The actuator is a double acting piston and cylinder arrangement operating between brackets attached to the cross members 20 and 32 respectively.

Extending forwardly and downwardly through the sleeves 34 are side rails 40 of a guide frame 42, the rails 40 being joined at top and bottom by cross members 44. The guide frame may be moved relative to the carriage 24 by means of double acting hydraulic actuators 46 acting between the sleeves 34 and hydraulically operated clamps 48 slidably mounted on the top flanges of the rails 40, which are of I cross section. The frame 42 may be stepped up or down to any desired position by appropriate alternate actuation of the actuators 46 and the clamps 48, first on one side and then the other.

The guide frame in turn supports a tool carrier 50 formed by a further carriage movable up and down the rails 40 guided by rollers 52 and 54 mounted on brackets 56 and 58 on a frame 60. The tool carrier 50 may be hauled up the rails 40 by means of a cable 62 connected to a windlass 64 on the frame 2. In order to avoid fouling, the cable passes over a pulley 66 mounted on the cross member 30.

A tool in the form of a scraper blade 66 is attached to the tool carrier by means of brackets 68 on the latter, the tool being connected to the brackets by means of pivot pins 70. The tool is located relative to the frame by stop blocks 72 which engage the frame 60 when the tool carrier is hauled up the guide frame 42 by means of the cable 62. However, when the tool carrier 50 moves downwardly, the blade 66 can hinge about the pins 70 into a trailing position as shown in FIG. 4.

The rails 40 of the guide frame 42 are additionally connected near the lower ends of their top webs by a cross member 74 which is pivotally attached by means of a pivot bracket 76 to a substantially vertically extending suspension tie in the form of a strut 78 which is received in a bracket 80 pivotally connected to the outer end of the jib 8 of the crane. A cable 82, actuated by the crane winding mechanism and passing over pulley blocks 84 and 86, is used to adjust the vertical position of the strut 78 and hence the angle assumed by the guide frame 42 as the apparatus of the invention is lifted about the pivots 12.

In use, and as will be best understood by reference to FIG. 1, the crane 2 is positioned at the top of a slope to be graded. In the example shown, the slope concerned is the bank of a river or other waterway, and the major portion of the slope to be graded is beneath the water level. In this type of application, it is possible, if this is desirable in order to reduce the loading on the crane, to attach near the bottom of the frame 42 a buoyancy tank or tanks 88. However, care should be taken not to counteract the weight of the apparatus to such an extent that an inadequate loading is applied to the scraper blade 66 during use.

Having positioned the crane 2, the angle of the guide frame 42 is set so that it corresponds to the desired angle of the slope to be graded, by raising or lowering the strut 78 and making any appropriate adjustments to the relationship between the tubular members 34 and 26. Additionally, the downward and outward extent of the frame 42 is adjusted during this operation by appropriate stepping actions utilizing the clamps 48 and the actuators 46. The tool 66 is also brought into the desired relationship with the slope 90 by moving the carriage 24 along the auxiliary jib 16 by means of the actuator 38. The actual grading operation can then be carried out by hauling the two cage 50 up the frame 42 by means of the cable 62, where upon the scraper blade 66 will carry out the grading operation. The carriage is permitted to return to its lower position under the action of gravity, during which the blade can assume a trailing position shown in FIG. 4 to avoid disrupting the work already done.

Where it is desired to cut back a bank through some distance, then it will be understood that the carriage 24 may be moved progressively rearwardly along the auxiliary jib 16 during successive stages of the cutting operation. Conversely, where the apparatus is being used to spread beds of material on the slope, the carriage 24 may be moved stepwise forwardly along the jib 16 during successive stages of the operation as the slope is built up.

Once one section of slope has been graded, the crane 2 may be moved forwardly along the bank to a new position and the operation repeated. Assuming that the length and angle of the slope to be graded remains the same, the only setting of the apparatus which should require readjustment during this operation is the position of the carriage 24. Correct positioning of the carriage may be facilitated or even automated by use of a conventional string line system, comprising for example a pendulum 92 suspended from the carriage 24 (see FIG. 1), and a string line 94 previously set out along the top of the slope.

It should be understood that the scraper blade 66 may be replaced by other forms of tool, as appropriate to the operation being carried out. Thus where quantities of material are to be removed, a bucket may be more appropriate than a scraper blade. Alternatively, where the apparatus is to be used to cut drainage channels into a bank or slope, a trenching tool may be utilized.

Although the apparatus has been illustrated in use as an attachment to a crane situated at the top of a slope to be graded or otherwise operated upon, it should be understood that the apparatus may readily be adapted for use with the crane situated at the bottom of the slope. In this case, the angle of the frame 42 relative to the jib 16 would be reversed, and it would be necessary for the cable 62 to be attached to the frame 60 of the tool carrier 50 via a pulley block situated at the outer end of the guide frame 42. The strut 78 would of course be elevated to an appropriate level. It will also be understood that the strut 78 could in suitable instances be replaced by a suspension tie formed by a simple cable connection. However, care must be taken in this case that the load imposed upon the tool by the frame 42 and its associated parts is sufficient to enable proper guiding of the tool without unwanted displacements of the frame by thrusts applied to it through the tool.

It will be seen that the invention, by means of a relatively simple attachment applicable to a conventional jib crane, provides a versatile grading machine readily capable of reaches considerably greater than those of conventional machines available for this purpose.

What I claim is:

1. A grading attachment for a jib crane, comprising a substantially horizontal auxiliary jib mounted on the crane beneath its main jib, a carriage mounted for fore and aft movement along the auxiliary jib, an elongated guide frame supported by the carriage, said guide frame extending longitudinally forwardly from the carriage at an inclination thereto, and said guide frame having side rails passing through and slidably mounted in sleeves secured to said carriage whereby the guide frame is movable on its longitudinal axis relative to the carriage, a tool carrier mounted for movement in either direction longitudinally along the guide frame, an earthworking tool mounted to and beneath the carrier, and a suspension tie connecting the guide frame to the main jib of the crane.

2. An attachment according to claim 1, wherein the inclination of the guide frame relative to the carriage is adjustable.

3. An attachment according to claim 1, wherein the carriage itself comprises sleeves slideable on parallel rails forming said auxiliary jib.

4. An attachment according to claim 3, wherein a hydraulic actuator is provided acting between the auxiliary jib and the carriage to control the position of the latter.

5. An attachment according to claim 1, wherein hydraulic clamps are provided on said side rails, and hydraulic actuators are provided acting between said clamps and said sleeves, whereby to step the guide frame relative to the sleeves.

6. An attachment according to claim 1, wherein a cable is provided connecting said tool carrier to a windlass on the crane whereby to enable the latter to haul the latter up the inclined guide frame.

7. An attachment according to claim 6, wherein the earthworking tool is a scraper blade hingedly mounted to the tool carrier whereby to allow the tool to trail as the carrier moves down the guide frame.

8. An attachment according to claim 1, wherein the guide frame is inclined downwardly from the carriage.

9. An attachment according to claim 4, wherein a pendulum is suspended from the carriage whereby to enable the latter to be aligned with a string line.

10. An attachment according to claim 1, wherein a buoyancy tank is attached to the guide frame.

11. An attachment according to claim 1, wherein the suspension tie is a rigid strut, and brackets pivotally connect the strut to the guide frame and to the main jib of the crane.

* * * * *